US005311618A

United States Patent [19]

Breimon et al.

[11] Patent Number: 5,311,618

[45] Date of Patent: May 17, 1994

[54] COMMODE SEAT SPACER ASSEMBLY

[76] Inventors: Kenneth V. Breimon; Mary Breimon, both of 12101 N.E. 5th St., Vancouver, Wash. 98684

[21] Appl. No.: 17,592

[22] Filed: Feb. 16, 1993

[51] Int. Cl.[5] ..... A47K 13/00

[52] U.S. Cl. ..... 4/239

[58] Field of Search ..... 4/235, 239

[56] References Cited

U.S. PATENT DOCUMENTS 4,930,165 6/1990 Wilson ..... 4/239

5,005,223 4/1991 Greenwood ..... 4/239 X 5,136,731 8/1992 Caro et al. ..... 4/239

*Primary Examiner*—Charles E. Phillips

*Attorney, Agent, or Firm*—Leon Gilden

[57] ABSTRACT

A spacer assembly mounted to an associated commode seat is provided to effect sanitized spacing for an individual utilizing the seat, wherein the spacer assembly includes a plurality of arcuate members, each having a plurality of spring finger leg portions extending from bottom walls of the assembly to secure opposed side walls of the commode seat.

2 Claims, 4 Drawing Sheets

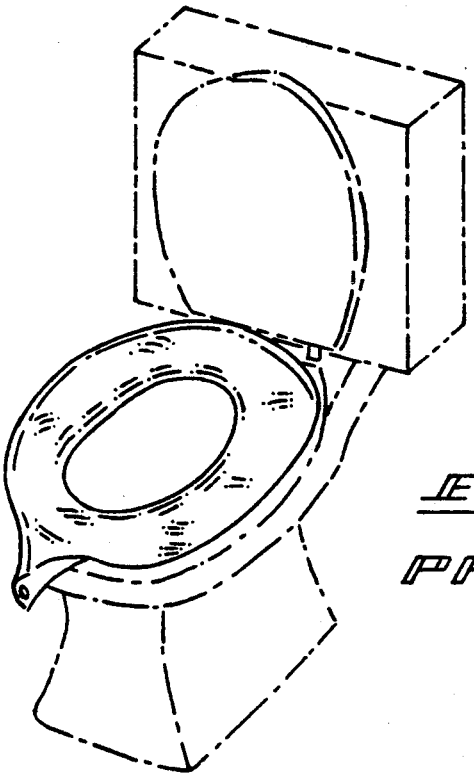
Fig 1
PRIOR ART
Fig 2
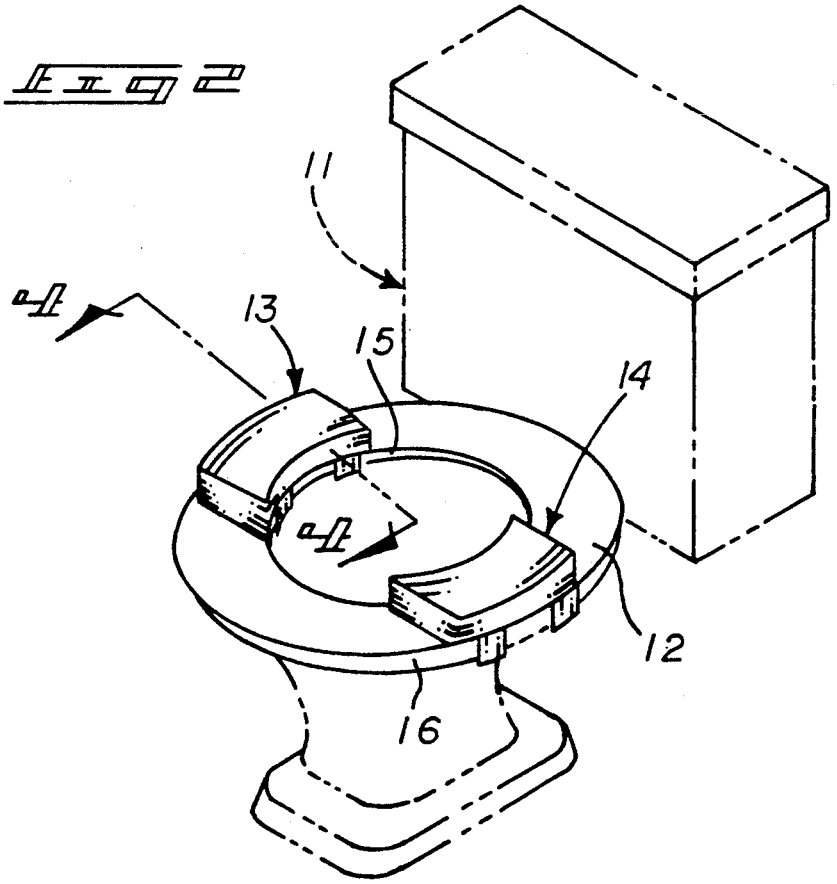

COMMODE SEAT SPACER ASSEMBLY

BACKGROUND OF THE INVENTION

1. Field of the Invention

The field of invention relates to commode apparatus, and more particularly pertains to a new and improved commode seat spacer assembly wherein the same is arranged for the temporary mounting to a commode seat to provide for spaced orientation of an individual relative to a commode seat during its use.

2. Description of the Prior Art

The contemporary spread of various disease and the like relative to the use of commercially available commode structure requires individuals to exert caution in the use of such commode structure. The instant invention attempts to overcome deficiencies of the prior art by providing for a portable commode seat spacer assembly wherein the same is directed to the mounting upon a conventional commode seat for temporary use of the commode.

Prior art set forth relative to auxiliary seat structure as indicated in U.S. Pat. Nos. 4,839,929 and 4,998,297 to include a flexible ring-shaped member having an upper surface arranged for mounting to an associated commode seat.

SUMMARY OF THE INVENTION

In view of the foregoing disadvantages inherent in the known types of commode seat apparatus now present in the prior art, the present invention provides a commode seat spacer assembly wherein the same is directed to the temporary mounting upon a commode seat for spaced use of the commode seat in a sanitized relationship. As such, the general purpose of the present invention, which will be described subsequently in greater detail, is to provide a new and improved commode seat spacer assembly which has all the advantages of the prior art commode seat apparatus and none of the disadvantages.

To attain this, the present invention provides a spacer assembly mounted to an associated commode seat to effect sanitized spacing for an individual utilizing the seat, wherein the spacer assembly includes a plurality of arcuate members, each having a plurality of spring finger leg portions extending from bottom walls of the assembly to secure opposed side walls of the commode seat.

My invention resides not in any one of these features per se, but rather in the particular combination of all of them herein disclosed and claimed and it is distinguished from the prior art in this particular combination of all of its structures for the functions specified.

There has thus been outlines, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, method and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved commode seat spacer assembly which has all the advantages of the prior art commode seat apparatus and none of the disadvantages.

It is another object of the present invention to provide a new and improved commode seat spacer assembly which may be easily and efficiently manufactured and marketed.

It is a further object of the present invention to provide a new and improved commode seat spacer assembly which is of a durable and reliable construction.

An even further object of the present invention is to provide a new and improved commode seat spacer assembly which is susceptible of a low cost of manufacture with regard to both materials and labor, and which accordingly is then susceptible of low prices of sale to the consuming public, thereby making such commode seat spacer assembly economically available to the buying public.

Still yet another object of the present invention is to provide a new and improved commode seat spacer assembly which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularly in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art commode seat cover, as indicated in U.S. Pat. No. 4,998,297, providing for a ring-like member arranged for positioning upon a commode seat.

FIG. 2 is an isometric illustration of the spacer members mounted to a commode seat.

DESCRIPTION OF THE PREFERRED EMBODIMENT

Figure 3:
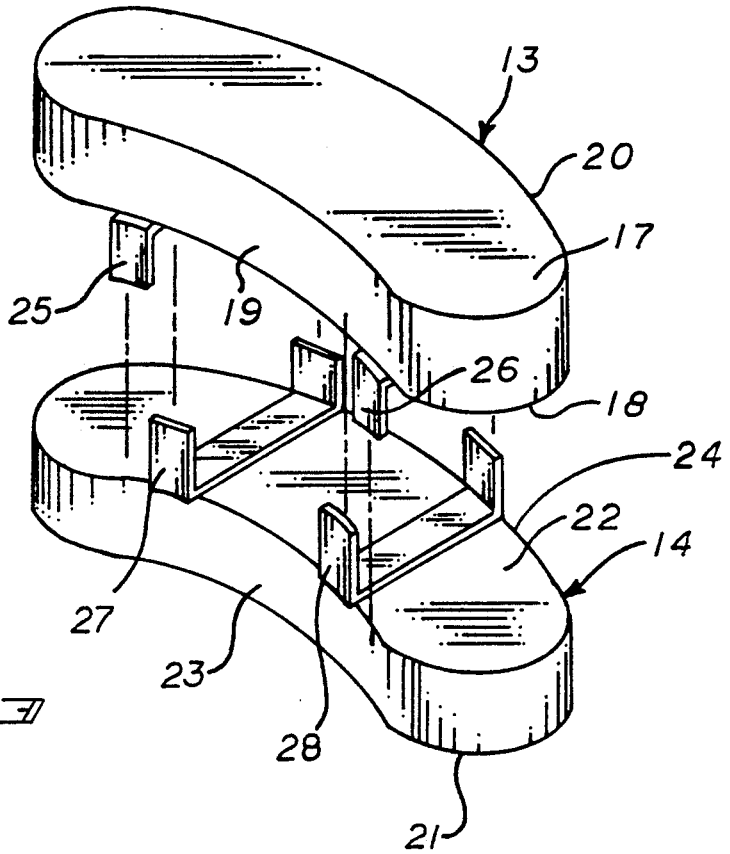
FIG. 3 is an isometric illustration of the spacer assemblies arranged for inter-fitting relationship relative to one another.
Figure 4:
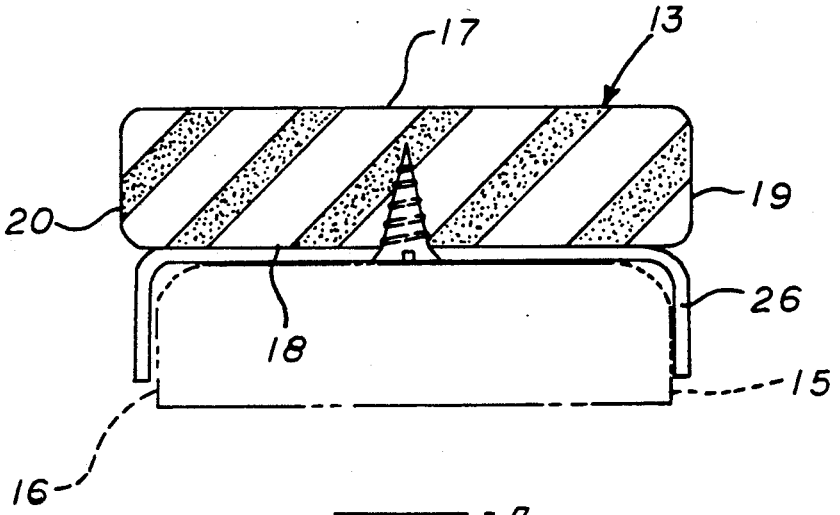
FIG. 4 is an orthographic view, taken along lines 4—4 of FIG. 2 in the direction indicated by the arrows.

With reference now to the drawings, and in particular to FIGS. 1 to 8 thereof, a new and improved commode seat spacer assembly embodying the principles and concepts of the present invention and generally designated by the reference numeral 10 will be described.

Figure 5:
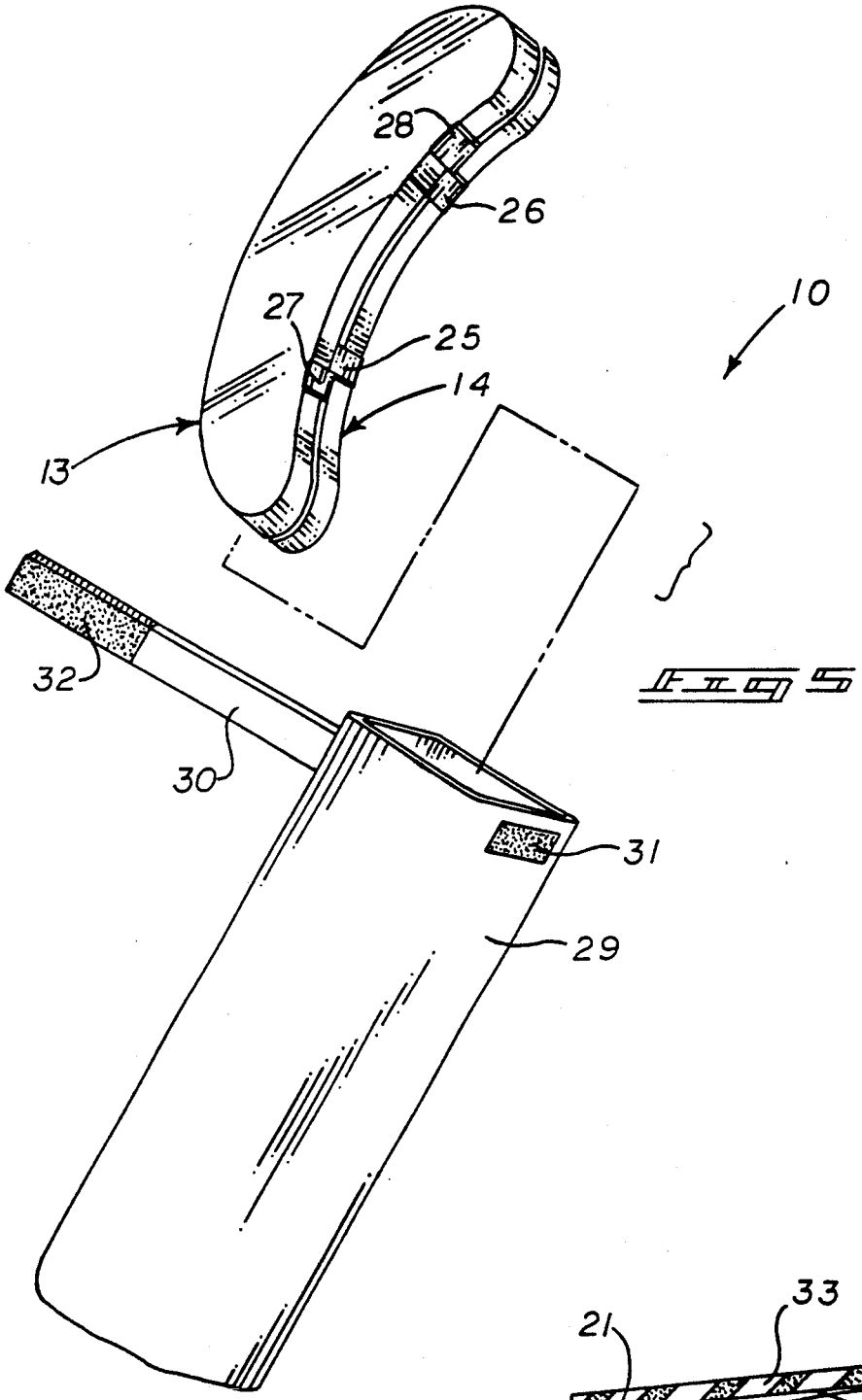
FIG. 5 is an isometric illustration of the invention including an associated storage and transport bag member.

More specifically, the commode seat spacer assembly 10 of the instant invention essentially comprises cooperative association with a commode 11, having a commode arcuate seat 12, with the seat 12 including a seat inner wall 15 spaced from a seat outer wall 16. First and second support members 13 and 14 respectively are mounted in a facing relationship on the commode seat 12. The first support member 13 includes a first top wall 17 spaced from a first bottom wall 18, a first concave arcuate inner side wall 19 spaced from a first convex outer side wall 20. The second support member 14 includes a second top wall 21 spaced from a second bottom wall 22, and a second concave arcuate inner side wall 23 in a facing relationship relative to the first inner side wall 19. A second convex arcuate outer side wall 24 is spaced from the second inner side wall 23 (see FIG. 3). First and second U-shaped brackets 25 and 26 are mounted to the first bottom wall 18, with the first and second U-shaped brackets 25 and 26 having spring fingers biased towards one another to engage the seat's inner and outer side walls 15 and 16. Similarly, the second bottom wall 22 includes third and fourth U-shaped brackets 27 and 28 having cooperative spring fingers to engage the seat's side walls. As indicated in FIG. 3, the first and second support members 13 and 14 are arranged for transport relative to one another in an engaging relationship, wherein the first bottom wall 18 is arranged for a facing and coextensive relationship relative to the second bottom wall 22. To this end, the first and second U-shaped brackets 25 and 26 respectively are offset relative to the third and fourth U-shaped brackets 26 and 27 that are mounted to the second bottom wall 22. In this manner, the first and second support members 13 and 14 are arranged for an engaging relationship relative to one another, as indicated in FIG. 5, for reception within an associated flexible bag 29, having a bag cavity to receive the first and second support members 13 and 14 in a secured relationship relative to one another, with the flexible bag 29 further including a securement strap 30 mounted adjacent the entrance opening of the flexible bag, with the securement strap 30 having a first fastener 31 mounted to the bag, and a second fastener 32 secured to a free distal end of the securement strap 30, wherein the first and second fasteners 31 and 32 are typically of a hook and loop fastener construction.

Figure 6:
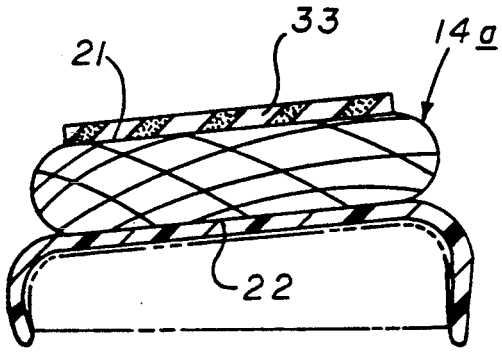
FIG. 6 is an orthographic cross-sectional illustration of a modified commode seat support member.

The FIG. 6 indicates the use of a modified support member construction (for purposes of example only, the further modified structure 14*a* is indicated, but it should be understood that such construction is identical for both support members 13 and 14). The modified support member 14*a* includes a polymeric resilient web 33 mounted to the support member top wall.

Figure 7:
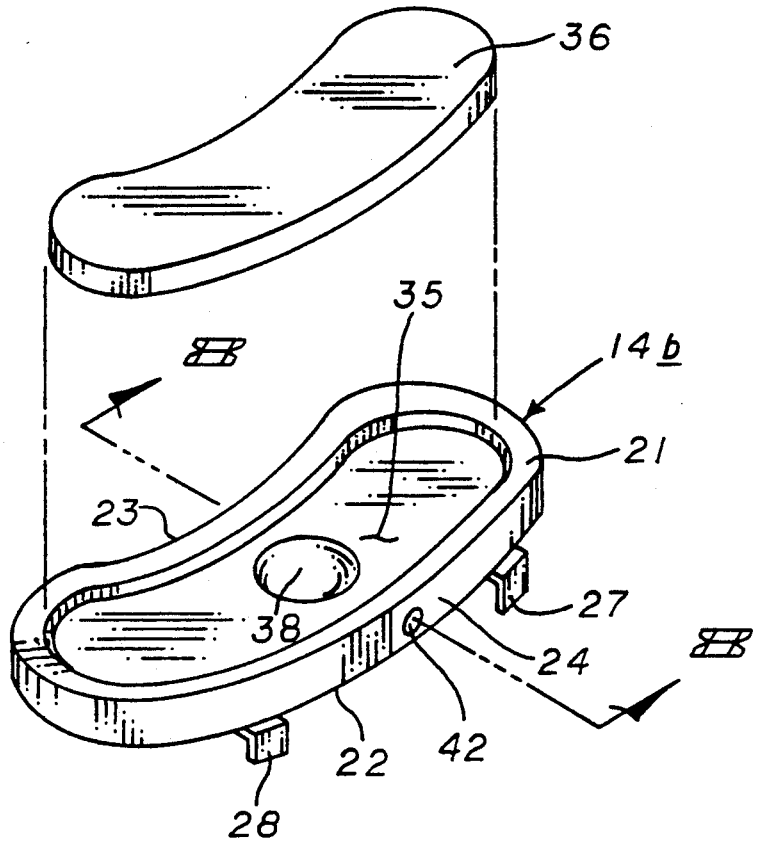
FIG. 7 is an isometric illustration of a further modified commode seat member.
Figure 8:
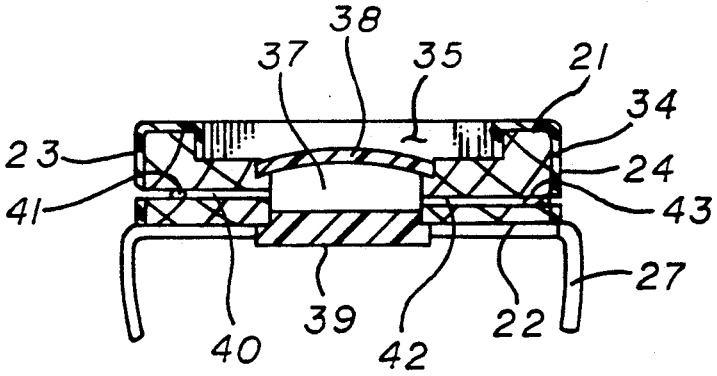
FIG. 8 is an orthographic view, taken along the lines 8—8 of FIG. 7 in the direction indicated by the arrows.

The FIGS. 7 and 8 indicates the use of a further modified support member, wherein at least one of the support members, such as the second support member 14, is configured such that the further modified support member 14*b* includes a polymeric fluid impermeable layer 35 mounted coextensively to the side walls and the top wall, with the second top wall 21 having a recess 35 directed into the second top wall, and the recess having a recess floor, with the recess floor exposing a resilient diaphragm 38 projecting above the recess floor, with the diaphragm 38 formed of a shape-retentive material arranged in a projecting relationship relative to the recess floor, as illustrated in FIG. 8. A fluid reservoir cavity 37 is directed within the second support member 14 between the recess floor and the second bottom wall 22. The second bottom wall 22 includes a fill plug 39 to permit the positioning of various fluids within the fluid reservoir cavity 37, such as bactericides, deodorizers and the like. First and second conduits 40 and 42 respectively extend in fluid communication from the fluid reservoir cavity 37 to the respective second inner and outer side walls 23 and 24 respectively, as indicated in FIG. 8.

Respective first and second check valves 41 and 43 are mounted within the first and second conduits to permit fluid flow only from the reservoir through the first and second conduits and projection from the first and second conduits exteriorly of the second support member 14 relative to the second concave and convex arcuate inner and outer side walls 23 and 24 respectively. In this manner, such fluid may be deposited within the commode, as well as exteriorly of the commode, during use of the organization. Further, a foam insert 36 is arranged for reception within the recess 35 in a coextensive and complementary relationship permitting ease of removal of the foam insert 36 for its maintenance, cleaning, and the like.

As to the manner of usage and operation of the instant invention, the same should be apparent from the above disclosure, and accordingly no further discussion relative to the manner of usage and operation of the instant invention shall be provided.

With respect to the above description the, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A commode seat spacer assembly arranged for mounting to a commode seat, wherein the spacer assembly comprises, a first support member and a second support member of a mirror image configuration, wherein the first support member includes a first top wall spaced from a first bottom wall, and a first concave arcuate inner side wall spaced from a first convex arcuate outer side wall, and the second support member includes a second top wall spaced from a second bottom wall and a second convex arcuate inner side wall spaced from a second convex outer side wall, wherein the first bottom wall is arranged for securement in the contiguous, complementary, and coextensive relationship relative to the second bottom wall for storage and transport, and a flexible bag having a bag cavity arranged for receiving the first support member and the second support member, wherein the first support member and the second support member are in an assembled relationship, with the first bottom wall in said facing relationship to said second bottom wall, with the flexible bag having an entrance opening and a securement strip mounted to the flexible bag adjacent the entrance opening, and the securement strip having a strip first end mounted to the flexible bag, and a strip second end, with a first hook and loop fastener mounted to the flexible bag, and a second hook and loop fastener mounted to the strip end for securement to the first hook and loop fastener, and the first bottom wall including a first U-shaped bracket and a second U-shaped bracket, wherein the first U-shaped bracket includes first spring fingers extending beyond the first bottom wall and the second U-shaped bracket includes second spring fingers extending beyond the first bottom wall, wherein the first spring fingers are laterally biased towards one another and the second spring fingers are laterally biased towards one another, and the second bottom wall includes a third U-shaped bracket having third spring fingers extending beyond the second bottom wall and a fourth U-shaped bracket having fourth spring fingers extending beyond the second bottom wall, wherein the third spring fingers are laterally biased towards one another, and the fourth spring fingers are laterally biased towards one another, and the first and second spring fingers are arranged for biased securement of the respective second concave and second convex inner and outer side walls, with the third and fourth spring fingers arranged for biased engagement of the respective first concave and first convex inner and outer side walls when the first member and the second support member are arranged with the first bottom wall in a facing relationship relative to the second bottom wall.

2. A spacer assembly as set forth in claim 1 wherein at least the second top wall includes a recess, the recess having a recess floor, and a fluid reservoir cavity directed between the recess floor and the second bottom wall, with the second bottom wall having a fill plug arranged for selective filling of fluid within said reservoir cavity, and a resilient diaphragm arranged in a biased projecting relationship from the reservoir mounted within the reservoir and projecting beyond the recess floor, with the diaphragm formed of a shape-retentive material, and a first conduit directed from the reservoir cavity to the second inner side wall, and a second conduit directed from the reservoir cavity to the second outer side wall, wherein the first conduit includes a first check valve and the second conduit includes a second check valve.

* * * * *